US009574394B2

(12) United States Patent
Hsu et al.

(10) Patent No.: US 9,574,394 B2
(45) Date of Patent: Feb. 21, 2017

(54) CORDLESS BLIND ASSEMBLY

(71) Applicant: CHING FENG HOME FASHIONS CO., LTD., Changhua County (TW)

(72) Inventors: Sheng Ying Hsu, Changhua County (TW); Wen Ying Liang, Changhua County (TW)

(73) Assignee: CHING FENG HOME FASHIONS CO., LTD., Changhua County (TW)

( * ) Notice: Subject to any disclaimer, the term of this patent is extended or adjusted under 35 U.S.C. 154(b) by 0 days.

(21) Appl. No.: 15/091,593

(22) Filed: Apr. 6, 2016

(65) Prior Publication Data

US 2016/0376838 A1 Dec. 29, 2016

(30) Foreign Application Priority Data

Jun. 29, 2015 (TW) ..... 104210409 U

(51) Int. Cl.

| | |
|---|---|
| ***E06B 9/28*** | (2006.01) |
| ***E06B 9/262*** | (2006.01) |
| ***E06B 9/386*** | (2006.01) |
| *E06B 9/24* | (2006.01) |
| *A47H 23/06* | (2006.01) |

(52) U.S. Cl.

CPC ..... *E06B 9/28* (2013.01); *E06B 9/262* (2013.01); *E06B 9/386* (2013.01); *A47H 23/06* (2013.01); *E06B 2009/2429* (2013.01); *E06B 2009/2452* (2013.01)

(58) Field of Classification Search

CPC ..... E06B 9/28; E06B 9/262; E06B 9/386; E06B 2009/2622; E06B 2009/2423; E06B 2009/2429; E06B 2009/2452; A47H 23/06; A47H 23/01; A47H 2201/01

USPC ..... 160/179, 348, 84.01

See application file for complete search history.

(56) References Cited

U.S. PATENT DOCUMENTS

| | | | | |
|---|---|---|---|---|
| 6,792,994 | B2 * | 9/2004 | Lin | E06B 9/262 160/84.03 |
| 6,832,642 | B2 * | 12/2004 | Titus | A47H 13/00 160/330 |
| 7,150,304 | B2 | 12/2006 | Hsu | |
| 7,523,778 | B2 * | 4/2009 | Roberts | A47H 23/08 160/237 |
| 8,905,114 | B1 * | 12/2014 | Whitaker | E06B 9/262 160/348 |
| 2010/0051209 | A1 * | 3/2010 | Liang | E06B 9/262 160/84.04 |
| 2012/0067531 | A1 * | 3/2012 | Ehrsam | A47H 1/18 160/368.1 |

(Continued)

FOREIGN PATENT DOCUMENTS

DE 9411139 U1 * 9/1994

*Primary Examiner* — Blair M Johnson

(57) ABSTRACT

A window curtain includes a first curtain body and multiple second curtain bodies attached to the first curtain body. The first curtain body allows light to penetrate therethrough. Each second curtain body has a connection edge formed on the top edge thereof so as to be connected to the first curtain body. Multiple first magnet units and multiple second magnet units are connected to the rear side of each second curtain body. The rear side faces the first curtain body. When folding either of the second curtain bodies relative to the first curtain body, the first and second magnet units are magnetically attracted to each other.

3 Claims, 6 Drawing Sheets

(56) References Cited

U.S. PATENT DOCUMENTS

| | | | | |
|---|---|---|---|---|
| 2012/0102707 | A1* | 5/2012 | Chen | E06B 9/262 29/428 |
| 2012/0234502 | A1* | 9/2012 | Chen | E06B 9/262 160/84.01 |

* cited by examiner

CORDLESS BLIND ASSEMBLY

BACKGROUND OF THE INVENTION

1. Fields of the Invention

The present invention relates to a window curtain, and more particularly, to a window curtain having a first curtain body and multiple second curtain bodies attached to the first curtain body, each second curtain body has magnet units which may be attracted to each other when folding the second curtain bodies.

2. Descriptions of Related Art

The conventional window curtains are equipped with operation ropes which hand downward from the top box, and the users pull the operation ropes to fold or expand the curtain. However, the hanging ropes can easily wrap around kids' neck when kids playing the operation ropes. Therefore, U.S. Pat. No. 7,150,304 discloses a cordless blind structure which includes multiple magnets connected to the blind body so that when the users operate the bar at the bottom of the blind to fold the blind body, the magnets are attracted row by row to fold the blind body in sequence. The blind body is expanded by pulling the bar downward to separate the magnets. No worm gears, pulleys and ropes are needed for the cordless blind structure.

However, when folding the blind body from the bottom thereof, the lower portion of the window that is not covered by the curtain body will introduce light into the room from outside. The light from outside of the room may be too bright for the users in the room.

The present invention intends to provide a cordless curtain which includes a first curtain body and multiple second curtain bodies which can be folded relative to the first curtain body by attracting magnet units on the second curtain bodies, so that the light outside of the room can be controlled to be introduced into the room.

SUMMARY OF THE INVENTION

The present invention relates to a window curtain and comprises a first curtain body which allows light to penetrate therethrough, and the top end of the first curtain body is connected to a top box. Multiple second curtain bodies each have the same width as the first curtain body. The length of each second curtain body is shorter than the length of the first curtain body. Each second curtain body has a front side, a rear side and a connection edge which is formed on the top edge of the second curtain body. The connection edge is connected to the first curtain body, and the rear side faces the first curtain body. When all of the multiple second curtain bodies expand, the first curtain body is covered by the second curtain bodies.

Multiple first magnet units and multiple second magnet units are connected to the rear side of each second curtain body. The first magnet units are attached to the lower portion of each of the second window bodies, and the multiple second magnet units are attached to the upper portion of each of the second window bodies. The first and second magnet units on each of the second curtain bodies are located in alignment with each other. When either of the second curtain bodies is folded relative to the first curtain body, the first and second magnet units are magnetically attracted to each other.

The advantages of the present invention are that when all of the second curtain bodies are expanded, the light cannot enter into the room. When one of more of the second curtain bodies is folded relative to the first curtain body, partial light is allowed to be introduced into the room.

The second curtain bodies can be selectively operated individually as needed.

The second curtain bodies are easily folded and positioned simply by attracting the first and second magnet units on each of the second curtain bodies.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
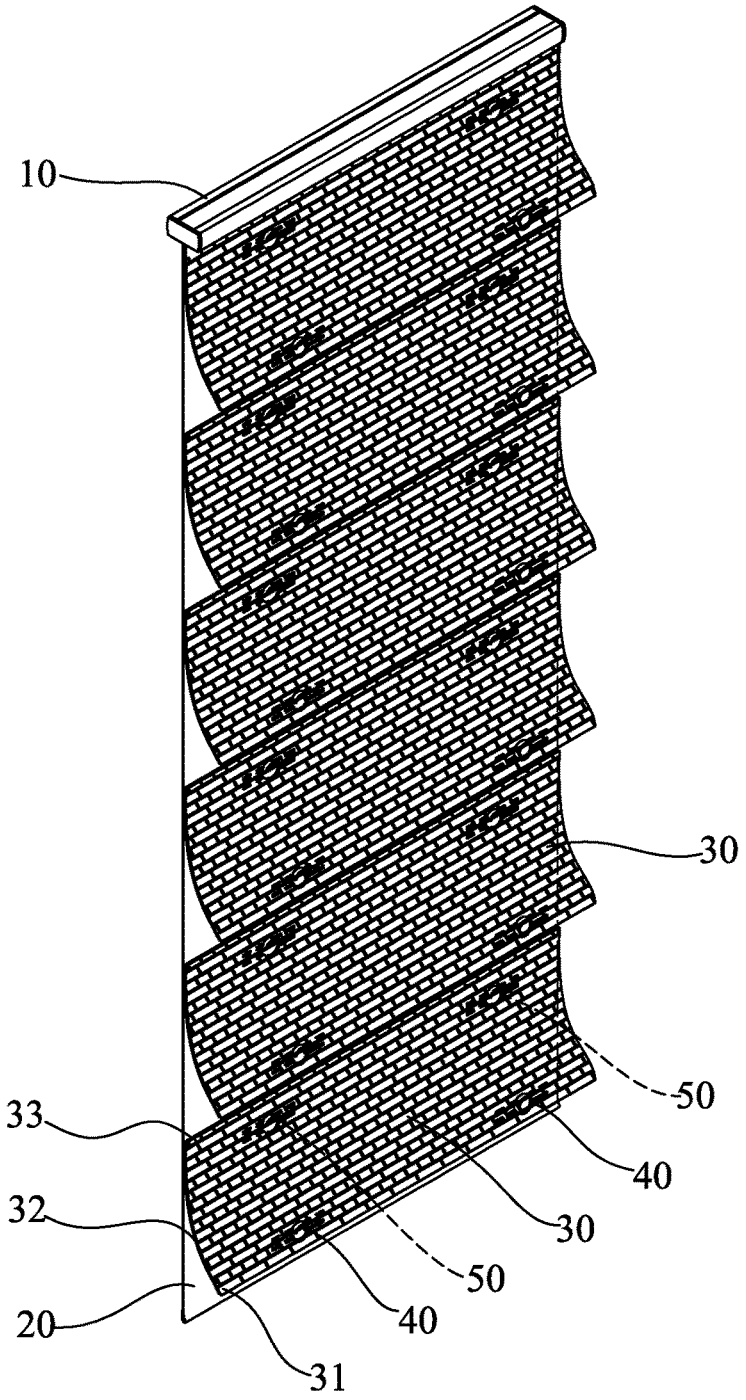
FIG. 1 is a perspective view to show the window curtain of the present invention, wherein the second curtain bodies are expanded.
Figure 2:
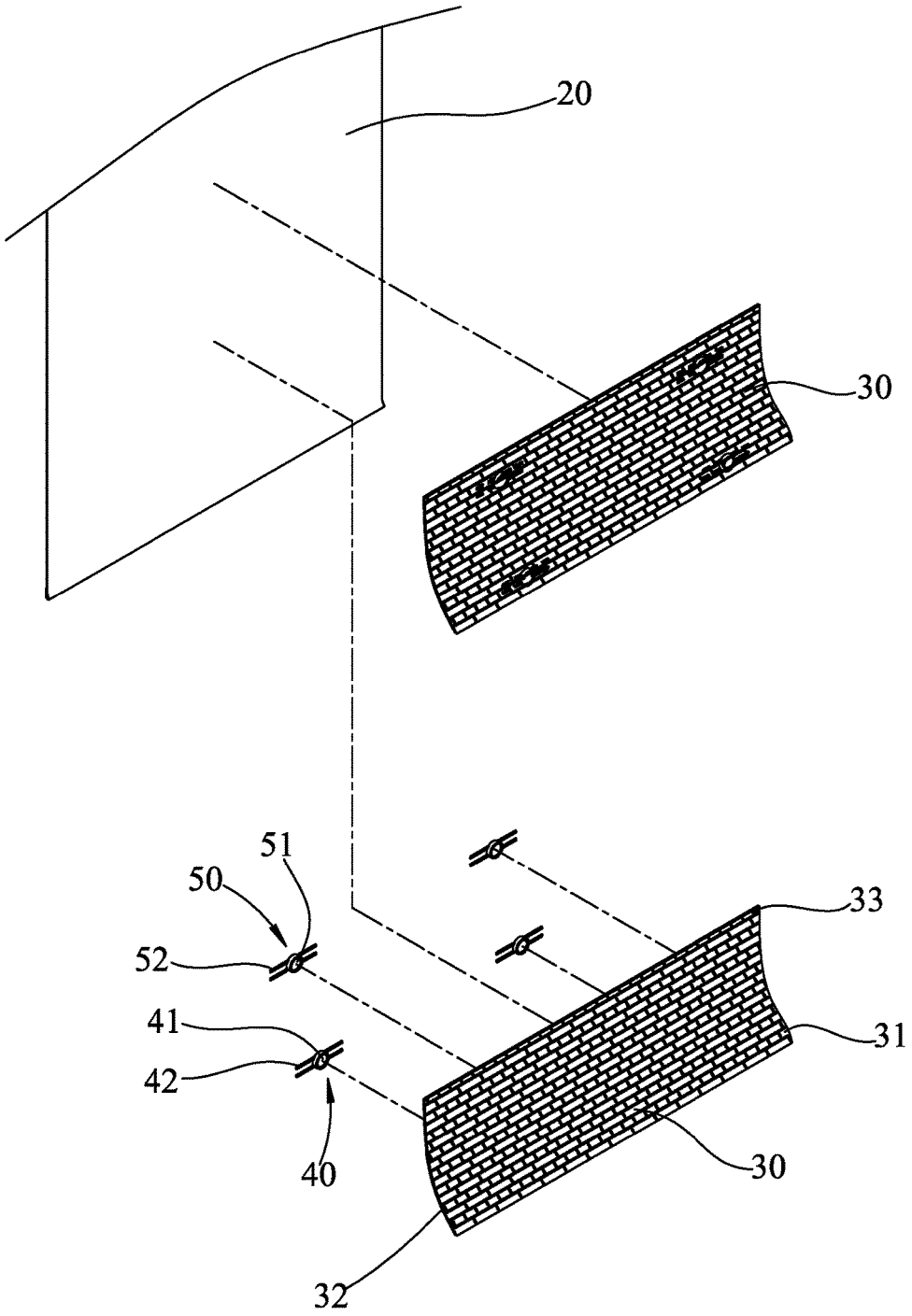
FIG. 2 is an exploded view to show a portion of the window curtain of the present invention.
Figure 3:
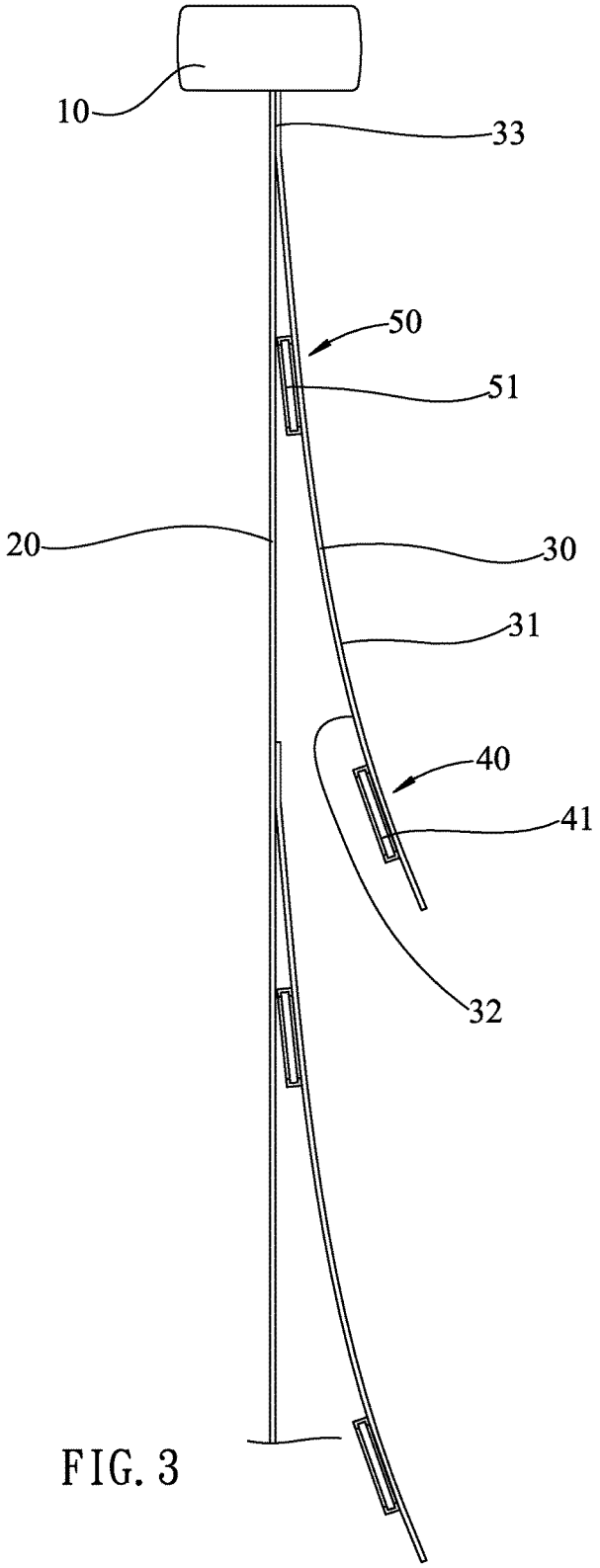
FIG. 3 is a side view of the window curtain of the present invention.

Referring to FIGS. 1 to 3, the window curtain of the present invention comprises a top box 10, a first curtain body 20, and multiple second curtain bodies 30. The first curtain body 20 allows light to penetrate therethrough completely or partially. The top end of the first curtain body 20 is connected to the top box 10.

The second curtain bodies 30 each have the width that is the same as the width of the first curtain body 20, and the length of each second curtain body 30 is shorter than the length of the first curtain body 20. Each second curtain body 30 has a front side 31, a rear side 32 and a connection edge 33 which is formed on the top edge of the second curtain body. The connection edge 33 is connected to the first curtain body 20, and the rear side 32 faces the first curtain body 20. When all of the multiple second curtain bodies 30 expand, the first curtain body 20 is completely covered by the second curtain bodies 30.

Figure 5:
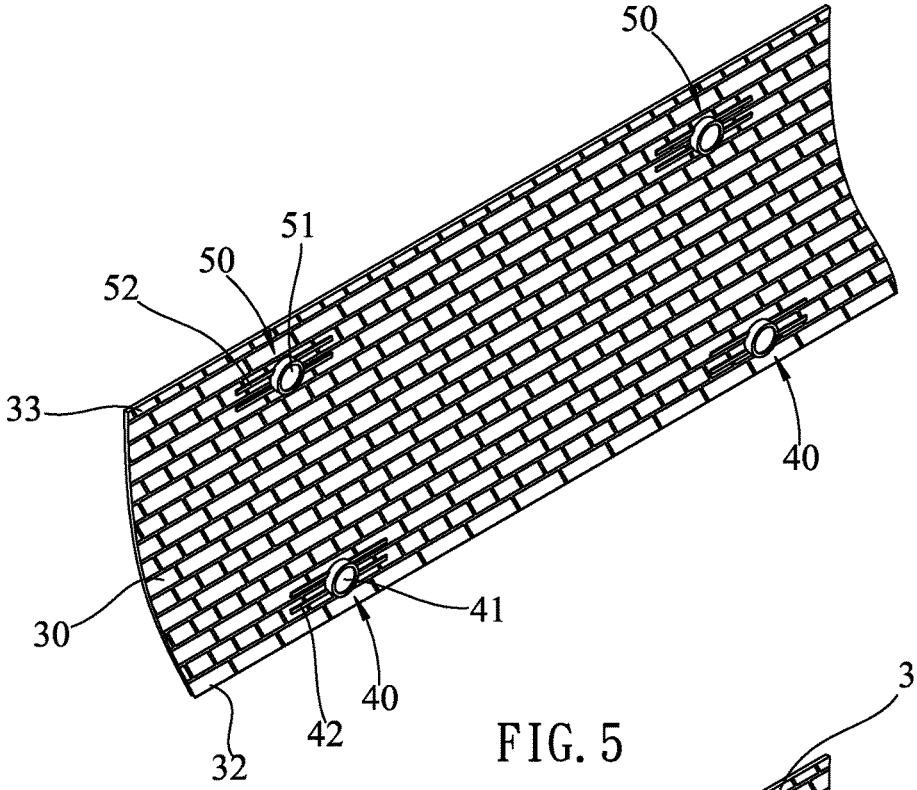
FIG. 5 shows the rear side of the second curtain body of the present invention.
Figure 4:
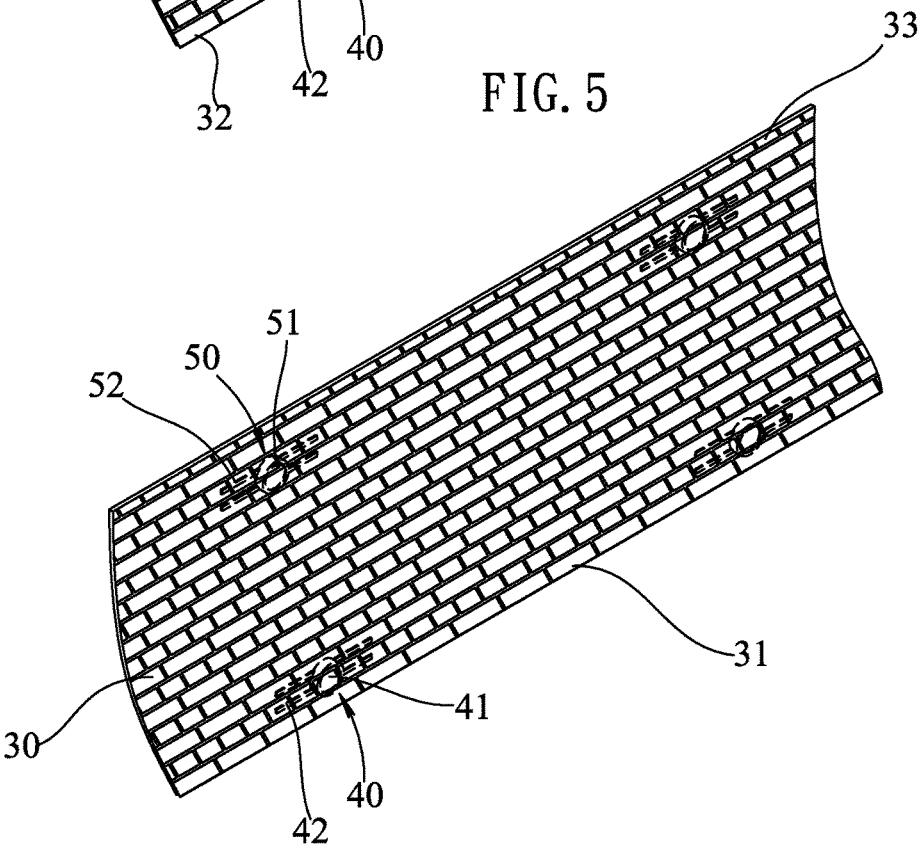
FIG. 4 shows the front side of the second curtain body of the present invention.

As shown in FIGS. 4 and 5, multiple first magnet units 40 and multiple second magnet units 50 are connected to the rear side 32 of each second curtain body 30. The first magnet units 40 are attached to the lower portion of each of the second window bodies 30, and the multiple second magnet units 50 are attached to the upper portion of each of the second window bodies 30. The first and second magnet units 40, 50 on each of the second curtain bodies 30 are located in alignment with each other. The first and second magnet units 40, 50 on each of the second curtain bodies 30 are identical and each have a magnet 41/52. Each magnet units 40/50 has two legs 42/52 extending therefrom which are fixed to the second curtain body 30 corresponding thereto by way of hot-welding or sewing. The first magnet units 40 are located at a distance from each other, and the second magnet units 50 are located at a distance from each other.

Figure 6:
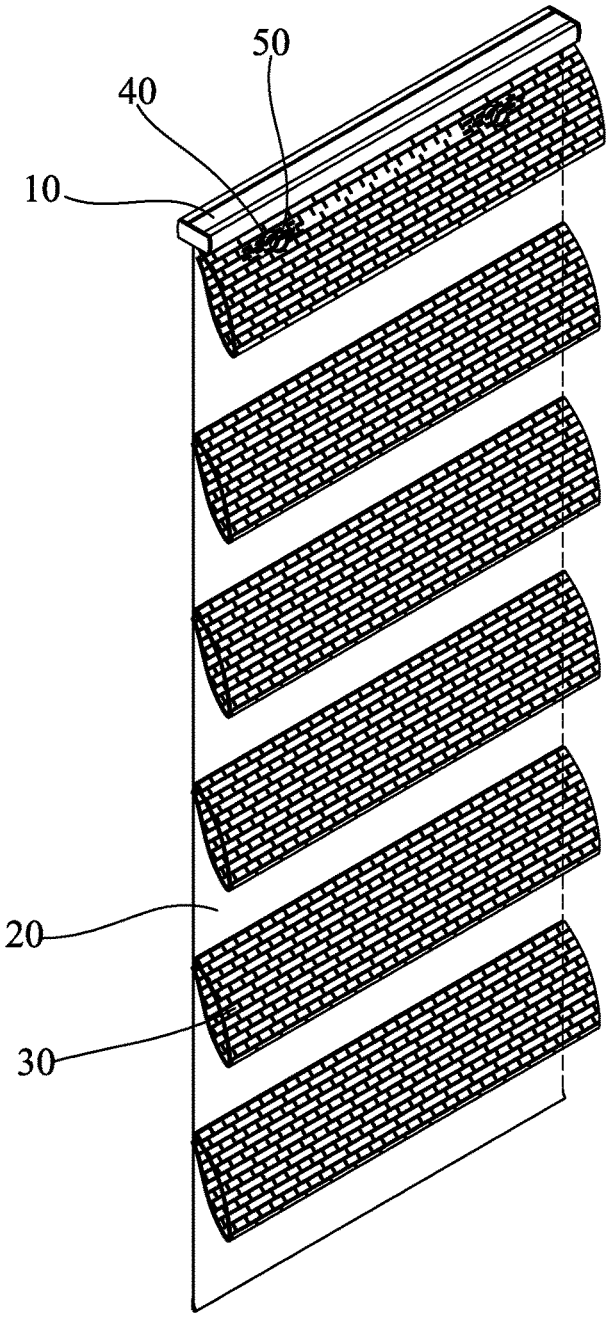
FIG. 6 shows that the second curtain bodies are folded relative to the first curtain body.
Figure 7:
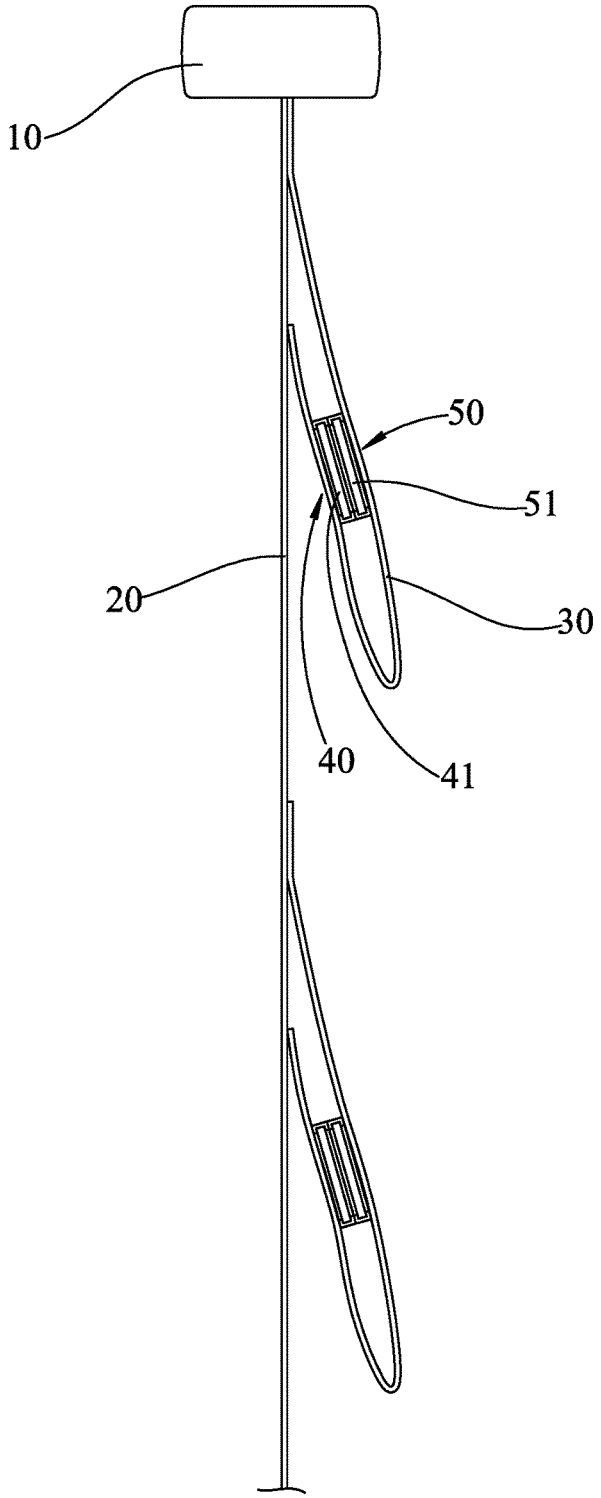
FIG. 7 is a side view to show that the first and second magnet units are attracted to each other when folding the second curtain bodies.

As shown in FIGS. 6 and 7, when either of the second curtain bodies 30 is folded relative to the first curtain body 20, the lower edge of the second curtain body 30 is folded upward and inward so that the first and second magnet units 40, 50 are magnetically attracted to each other as shown in FIGS. 6 and 7. The second curtain bodies 30 can be selectively folded individually according to the range that is allowed the light to enter into the room. When the second curtain bodies 30 are folded, because the first curtain body 20 allows the light to partially enter into the room, so that the light in the room is not too bright.

When expanding the second curtain bodies 30, the user simply applies a force to separate the first and second magnet units 40, 50 from each other, the second curtain bodies 30 are expanded. The second curtain bodies 30 can be folded or expanded at any position relative to the first curtain body 20 according to needs.

While we have shown and described the embodiment in accordance with the present invention, it should be clear to those skilled in the art that further embodiments may be made without departing from the scope of the present invention.

What is claimed is:

1. A window curtain comprising:

a first curtain body which allows light to penetrate therethrough, a top end of the first curtain body connected to a top box;

multiple second curtain bodies each having a width that is the same as a width of the first curtain body, a length of each second curtain body being shorter than a length of the first curtain body, each second curtain body having a front side, a rear side and a connection edge which is formed on a top edge of the second curtain body, the connection edge connected to the first curtain body, the rear side facing the first curtain body, when all of the multiple second curtain bodies expand, the first curtain body is covered by the second curtain bodies, and multiple first magnet units and multiple second magnet units connected to the rear side of each second curtain body, the first magnet units attached to a lower portion of each of the second window bodies, the multiple second magnet units attached to an upper portion of each of the second window bodies, the first and second magnet units on each of the second curtain bodies being located in alignment with each other, when either of the second curtain bodies is folded relative to the first curtain body, the first and second magnet units are magnetically attracted to each other.

2. The window curtain as claimed in claim 1, wherein the first and second magnet units on each of the second curtain bodies are identical and each have a magnet, each magnet unit has two legs extending therefrom which are fixed to the second curtain body corresponding thereto.

3. The window curtain as claimed in claim 1, wherein the first magnet units are located at a distance from each other, the second magnet units are located at a distance from each other.

* * * * *